United States Patent [19]

Nakajima

[11] 4,230,560

[45] Oct. 28, 1980

[54] NONMAGNETIC CONDUCTIVE MATERIAL SEPARATING APPARATUS

[75] Inventor: Takato Nakajima, Sakakimachi, Japan

[73] Assignee: Kanetsu Kogyo Kabushiki Kaisha, Ueda, Japan

[21] Appl. No.: 59,648

[22] Filed: Jul. 23, 1979

[30] Foreign Application Priority Data

Aug. 15, 1978 [JP] Japan ..... 53/98711

[51] Int. Cl.[3] ..... B03C 1/12

[52] U.S. Cl. ..... 209/212; 209/221

[58] Field of Search ..... 209/216, 219, 221, 226, 209/230, 231, 212, 213, 215, 220; 210/222, 223

[56] References Cited

U.S. PATENT DOCUMENTS

| | | | |
|---|---|---|---|
| 2,660,308 | 11/1953 | Fisher | 209/221 X |
| 3,327,852 | 6/1967 | Mortsell | 209/219 |
| 4,016,071 | 4/1977 | Paterson | 209/221 X |
| 4,046,679 | 9/1977 | Schloemann | 209/221 X |

FOREIGN PATENT DOCUMENTS

| | | |
|---|---|---|
| 37-4009 | 6/1962 | Japan . |
| 50-23911 | 7/1975 | Japan . |
| 50-124256 | 9/1975 | Japan . |
| 52-67870 | 6/1977 | Japan . |
| 53-51569 | 5/1978 | Japan . |

*Primary Examiner*—William A. Cuchlinski, Jr.
*Attorney, Agent, or Firm*—Graybeal & Uhlir

[57] ABSTRACT

A nonmagnetic conductive material separating apparatus designed for separation of conductive material from non-conductive material, comprising a drum composed of nonmagnetic substance and rotated in one direction around its longitudinal center axis, and means for generating a magnetic field rotated in the direction reverse to that of the drum. Composite input material posterior to previous removal of magnetic substance therefrom is introduced into the cylinder, and the nonconductive material contained in the entire input material is directed to the rotational direction of the drum along the inner wall thereof, while the conductive material is directed to the reverse direction by the electromagnetic force of the rotating-field generating means.

5 Claims, 5 Drawing Figures

NONMAGNETIC CONDUCTIVE MATERIAL SEPARATING APPARATUS

BACKGROUND OF THE INVENTION

1. Field of the Invention

This invention relates to an apparatus for efficiently separating nonmagnetic conductive material such as aluminum or copper from composite input material fed posterior to previous removal of magnetic substance therefrom.

2. Description of the Prior Art

One of the nonmagnetic conductive material separators known heretofore is of the type that is equipped with a rotatable drum having two open ends with its longitudinal center axis inclined, wherein a multiplicity of magnets of mutually opposite polarities are arrayed alternately on the inner surface of the drum with an inclination to the center axis thereof.

The magnets, when rotated in one direction together with the drum, generate a magnetic field rotating in the same direction as that of the drum, and the rotating field thus obtained causes an eddy current in nonmagnetic conductive material contained in the composite input material introduced into the drum through its upper open end. Since the pole boundary lines of the magnets are inclined to the axis of rotation of the drum, the electromagnetic force produced by the eddy current exerts its component on the nonmagnetic conductive material through the inclined drum toward its upper open end. Consequently, according to the above separator, the nonmagnetic conductive material is moved toward the upper open end of the drum against the nonconductive material falling toward the lower open end through the drum due to the weight of gravity, so that the nonmagnetic conductive material can be separated from the input material.

In such a separator, however, the nonmagnetic conductive material and the nonconductive material in the drum are not separated from each other in the circumferential direction of the drum, and the nonmagnetic conductive material is directed toward the upper open end of the drum while being kept in mixture with the nonconductive material. It frequently occurs, therefore, that the nonmagnetic conductive material is accompanied by the nonconductive material to bring about difficulty in achieving positive separation thereof.

In order to enhance the efficiency of separating the nonmagnetic conductive material from the nonconductive material, one method contrivable is to increase the electromagnetic force produced by the eddy current. However, because of the known structure that the magnets for generating a rotating magnetic field are integrated with the drum, it becomes necessary to increase the rotation speed of the drum itself to attain a higher rotation speed of the magnetic field. In this case, when the rotation speed of the drum exceeds a certain value, the separation efficiency is reduced to be extremely low to the contrary by the centrifugal force exerted onto the input material in the drum. Thus, there has been a disadvantage of low separation efficiency in the conventional separators.

SUMMARY OF THE INVENTION

It is an object of the present invention to provide an improved apparatus which is capable of separating nonmagnetic conductive material from nonconductive material with certainty and high efficiency.

According to the present invention, during unidirectional rotation of a drum containing composite input material posterior to previous removal of magnetic substance therefrom, a magnetic field rotating in the direction reverse to rotation of the drum is applied to nonmagnetic conductive material in the drum.

Consequently, the entire input material except the nonmagnetic conductive material in the drum is turned in the rotational direction of the drum with its rotation, while the nonmagnetic conductive material is turned in the reverse direction by the rotating field, so that the nonmagnetic conductive material and the nonconductive material are separated with certainty from each other in mutually reverse directions along the circumference of the drum. Moreover, since the magnetic field is rotated independently of rotation of the drum in the present invention, it is possible to attain high-speed rotation of the magnetic field without increasing the rotation speed of the drum, that is, without exerting a great centrifugal force onto the input material in the drum, thereby enabling the eddy current to produce a great electromagnetic force and exerting the same onto the nonmagnetic conductive material to enhance the separation efficiency.

DESCRIPTION OF THE PREFERRED EMBODIMENTS

Figure 1:
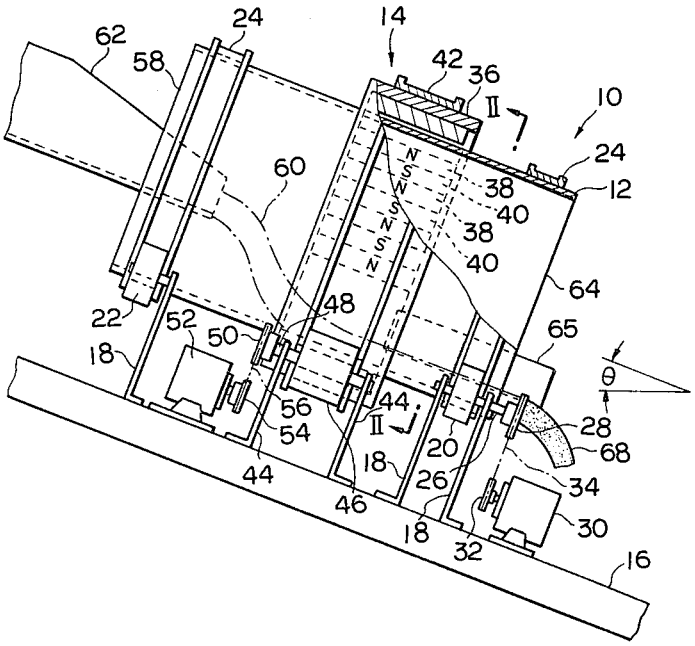
FIG. 1 is a vertical sectional view of a separating apparatus of the present invention.
Figure 2:
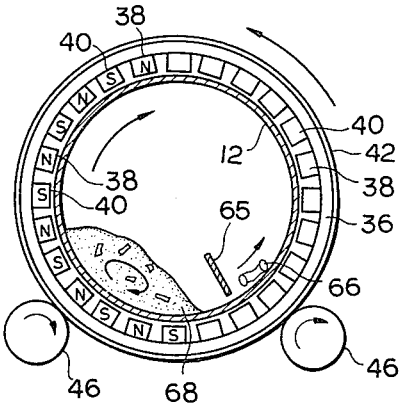
FIG. 2 is a cross sectional view taken along the line II—II shown in FIG. 1.

As shown in FIGS. 1 and 2, a separating apparatus 10 of this invention comprises a drum 12 of a nonmagnetic substance open at both ends thereof, means 14 for generating a rotating magnetic field, and a frame 16 for supporting the drum rotatably.

The frame 16 is disposed with inclination and is equipped with a pair of driving rollers 20 and a pair of driven rollers 22 which are held rotatably at an interval by brackets 18.

The drum 12 is mounted on the rollers 20 and 22 via annular guides 24 provided on the outer surface of the drum 12 in the vicinity of the both ends thereof, so that the drum 12 is supported to be rotatable around its longitudinal center axis in the state where the center axis has an angle $\theta$ of inclination with a horizontal plane.

A rotatory torque is transmitted to shafts 26 of the driving rollers 20 from a driving motor 30 provided on the inclined frame 16 via a chain 34 which is engaged with sprockets 28 secured to the shafts 26 and also with another sprocket 32 secured to the output shaft of the motor 30, thereby driving the drum 12 to rotate clockwise as viewed in FIG. 2.

The rotating-field generating means 14 is equipped with an external ring 36 which has an inner diameter larger than the outer diameter of the drum 12 and is disposed around the center portion of the drum, and also with a multiplicity of magnets 38 and 40 arranged in the circumferential direction of the external ring 36 and embedded in the inner wall thereof.

The outer surface of the external ring 36 is equipped with an annular guide 42, which is mounted on a pair of driving rollers 46 supported on the inclined frame 16 by means of brackets 44, so that the external ring 36 is held coaxially with the drum 12 in a rotatable manner while being spaced apart therefrom. A rotatory torque is transmitted to shafts 48 of the driving rollers 46 from a driving motor 52 provided on the inclined frame 16 via a chain 56 which is engaged with sprockets 50 secured to the shafts 48 and also with another sprocket 54 secured to the output shaft of the driving motor 52, thereby driving the external ring 36 to rotate in the direction reverse to that of the drum 12 or counterclockwise as viewed in FIG. 2.

A driving source for rotating the drum 12 and the external ring 36 in mutually reverse directions may be constituted by a single motor instead of the two motors 30 and 52. In such a case, the torque of the motor is transmitted to the two rotary members 12 and 36 via gears or the like to cause rotations in mutually reverse directions at speed different from each other.

The multiple magnets 38 and 40, which are embedded in the inner wall of the external ring 36 rotated in the direction reverse to rotation of the drum 12, are so arrayed as to surround the drum 12 with a space kept therefrom as shown in FIG. 2, wherein the pole faces opposed to the outer surface of the drum 12 have different polarities alternately. And the pole boundary line of each of the magnets 38 and 40 extends in parallel with the axis of rotation of the external ring 36 or that of the drum 12, as illustrated in FIG. 1.

A chute 62 is disposed at the upper open end 58 of the inclined drum 12 for continuously feeding therein composite input material 60 from which magnetic substance is already removed. It is preferred that a known vibrating mechanism be provided to vibrate the chute 62 for achieving smooth and continuous feed of the input material 60.

In the lower open end 64 of the drum 12, a separating plate 65 is disposed at a position slightly deviating in the rotational direction of the external ring 36 from the lower edge of the open end 64 and extends toward the center of the drum 12. The separating plate 65 is secured to the inclined frame 16 while being spaced apart slightly from the inner wall of the drum 12 rotated.

The input material 60, which is introudced through the chute 62 into the upper open end 58 of the drum 12 rotated in the direction reverse to the external ring 36, is directed toward the lower open end 64 due to its weight of gravity. Then, nonmagnetic conductive material 66 such as aluminum or copper contained in the input material 60 comes to traverse the magnetic flux of the rotating field relatively when passing through the magnetic field area obtained with rotation of the external ring 36. As a result, an eddy current is induced in the conductive material 66 and exerts an electromagnetic force in cooperation with the rotating field onto the conductive material 66 in the direction reverse to rotation of the drum 12. Consequently, as shown in FIG. 2, the conductive material 66 is directed toward the lower open end 64 while being deflected in the direction reverse to rotation of the drum 12 along the bottom thereof.

In the meanwhile, the nonconductive material 68 including paper scraps and wooden pieces in the composite input material 60 except the conductive material 66 also passes through the area of the rotating field, but no eddy current is induced therein. Accordingly, as shown in FIG. 2, the nonconductive material 68 is directed toward the lower open end 64 of the drum 12 with rotation thereof while being deflected in the rotational direction of the drum, which is reverse to that of the conductive material 66, along the bottom of the drum.

Posterior to passage through the area of the rotating field, the conductive material 66 is no longer subjected to the electromagnetic force but is kept free from mixing the nonconductive material 68 by the separating plate 65. As a result, the conductive material 66 is ejected sequentially from the open edge on one side of the separating plate 65, while the nonconductive material 68 is ejected sequentially from the open edge on the other side, and thus the nonmagnetic conductive material 66 is collected in succession through separation from the input material 60.

In the separating apparatus 10, the magnetic field is permitted to rotate at a high speed independently of the rotary drum 12. It becomes possible, therefore, to exert a great electromagnetic force onto the conductive material 66 in the composite input material 60 without applying a great-centrifugual force to the input material 60 in the drum 12, thereby ensuring certain separation and collection of the nonmagnetic conductive material 66 at a high efficiency.

Although FIGS. 1 and 2 illustrate example where the axes of rotation of both the drum 12 and the rotating-field generating means 14 are inclined, the two axes may be horizontal as well. In such a case, however, continuous ejection of the nonmagnetic conductive material is rendered impossible, so that is becomes necessary to perform an operation of taking out the separated nonmagnetic conductive material from the drum 12.

Figure 3:
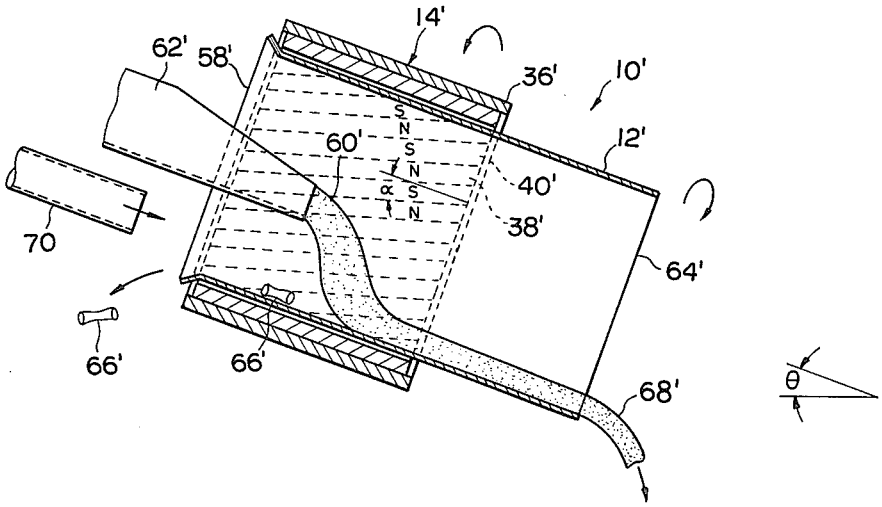
FIG. 3 is a vertical sectional view of another embodiment of the invention.

Another separating apparatus 10' shown in FIG. 3 comprises a drum 12' of a nonmagnetic substance with two open ends similar to the drum of FIG. 2, and means 14' for generating a rotating magnetic field.

The drum 12' is mounted on driving rollers and driven rollers (not shown) supported on an inclined frame as shown in FIGS. 1 and 2, and is supported to be rotatable around its longitudinal center axis inclined to a horizontal plane by an angle $\phi$. The drum 12' is rotated unidirectionally by a drive mechanism which is mounted on the inclined frame and is equipped with a drive motor similar to the aforementioned one.

The rotating-field generating means 14' has an external ring 36' disposed coaxially with the drum 12' in the vicinity of its upper open end 58' in the manner to surround the upper half of the drum 12'. The external ring 36' is mounted on unshown driving rollers which are supported by the inclined frame and are rotated by a drive mechanism similar to the one shown in FIGS. 1 and 2, so that the ring 36' is rotated in the direction reverse to rotation of the drum 12'.

In the inner wall of the external ring 36' a multiplicity of magnets 38' and 40' are embedded in the same manner as shown in FIG. 2 to surround the drum 12' while being spaced apart therefrom. The magnets 38' and 40' are so arrayed as shown in FIG. 3, wherein the respective pole faces have different polarities alternately and the pole boundary line of each magnet has an angle $\alpha$ of inclination to the axis of rotation of the external ring 36' or that of the drum 12′ in the manner to have a torsion in the same direction as rotation of the drum 12′ as viewed from the upper open end 58′ of the drum 12′.

Accordingly, out of the entire input material 60′ fed into the drum 12′ through the chute 62′, the nonconductive material 68′ except the nonmagnetic conductive material 66′ is directed toward the lower open end 64′ from the upper open end 58′ of the drum 12′ while being deflected in the rotational direction of the drum 12′ without being affected by the rotating magnetic field generated with rotation of the external ring 36′ in the same way as shown in FIGS. 1 and 2. In the meanwhile, in the nonmagnetic conductive material 66′ contained in the composite input material 60′, an eddy current is induced in the area of the rotating field. In this case, since each pole boundary line has a torsion as mentioned above, the electromagnetic force exerted onto the conductive material 66′ in cooperation with the eddy current and the rotating field has a transverse component applied in the rotational direction of the external ring 36′ or in the direction reverse to rotation of the drum 12′ and a longitudinal component applied toward the upper open end 58′. As a result, the conductive material 66′ in the composite input material 60′ is moved toward the upper open end 58′ of the drum 12′ while being deflected in the direction reverse to the deflection of the nonconductive material 68′, so that the conductive material 66′ can be collected sequentially from the upper open end 58′ of the drum 12′. In the example of FIG. 3, an air nozzle 70 is disposed in the vicinity of the upper open end 58′ of the drum 12′ so as to prevent the conductive material 66′ from trailing paper scraps through entanglement.

During the travel of the conductive material 66′ toward the upper open end 58′, the conductive material 66′ and the nonconductive material 68′ advance in the separated state in mutually reverse directions along the circumference of the drum 12′, so that the conductive material 66′ is kept free from mixing with the nonconductive material 68′ during its travel. Moreover, by virtue of the advantage that the magnetic field is permitted to rotate at a high speed independently of the drum 12′ into which the input material is introduced, it is possible to exert a great electromagnetic force of the rotating field onto the conductive material 66′ in the input material without applying a great centrifugal force to the input material in the drum 12′, thereby achieving efficient separation and collection of the conductive material 66′.

The axes of rotation of both the drum 12′ and the external ring 36′ may also be horizontal. In this case, the conductive material is moved toward one open end as in the foregoing embodiment by the longitudinal component of the electromagnetic force, while the nonconductive material is accumulated in the drum 12′ without being directed to the open ends thereof. It is necessary, therefore, to eject the accumulated nonconductive material periodically from the drum 12′.

Furthermore, the pole boundary face of each of the magnets 38′ and 40′ embedded in the inner wall of the external ring 36′ may be inclined reversely to have a torsion in the direction reverse to that shown in FIG. 3. In such a structure, the longitudinal component of the electromagnetic force exerted onto the conductive material 66′ is applied toward the lower open end 64′ of the drum 12′, so that the conductive material 66′ is ejected sequentially from the lower open end 64′ of the drum 12′ similarly to the nonconductive material 68′. Accordingly, it is preferred that a separating plate be disposed at the lower open end 64′ of the drum 12′ as shown in FIGS. 1 and 2.

Figure 4:
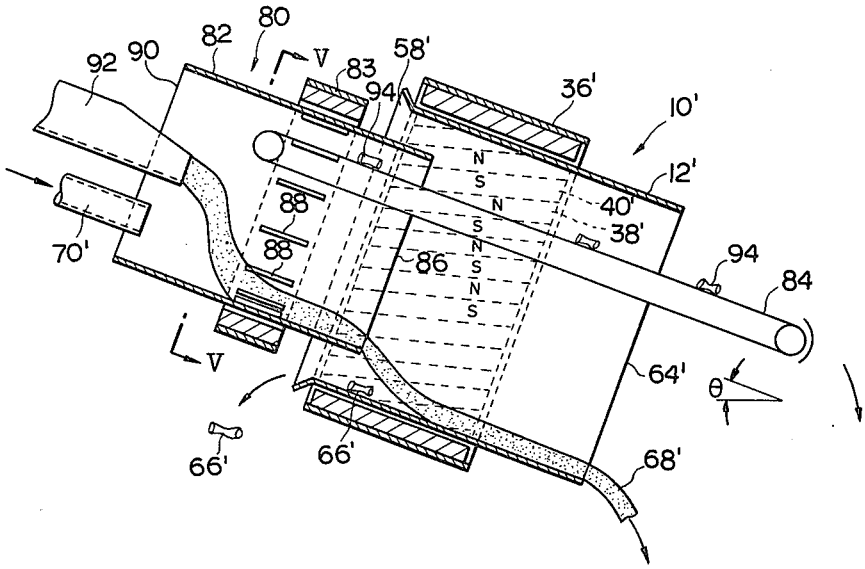
FIG. 4 is a vertical sectional view of an example implemented by combining the separating apparatus shown in FIG. 3 with a magnetic separator.

FIG. 4 shows an example implemented by combining the said separating apparatus 10′ of this invention with a known magnetic separator 80.

Figure 5:
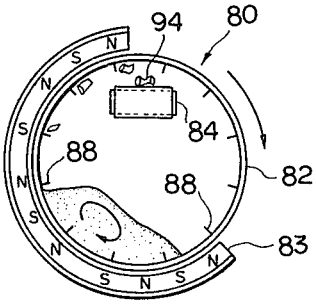
FIG. 5 is a cross sectional view taken along the line V—V shown in FIG. 4.

As illustrated in FIG. 5, the magnetic separator 80 comprises a drum 82 of a nonmagnetic substance open at both ends thereof, a stationary magnetic belt 83 spaced apart from the drum 82 and extending from the lower portion thereof along the outer surface of the drum 82 up to the top thereof, and a conveyor 84.

The drum 82 has an outer diameter smaller than the inner diameter of the drum 12′ and is in alignment therewith. And the lower open end 86 of the drum 82 is fitted into the upper open end 58′ of the drum 12′. The drum 82 is driven by a known drive mechanism to rotate around its longitudinal center axis clockwise as viewed in FIG. 5. A multiplicity of fins 88 are secured in the center region on the outer surface of the drum 82 at intervals in the circumferential direction. And an air nozzle 70′ similar to the aforementioned one and a chute 92 for guiding composite input material including magnetic substance are disposed at the upper open end 90 of the drum 82.

The composite input material fed into the drum 82 via the chute 92 advances toward the lower open end 86 through the rotating drum 82 due to the weight of gravity while being agitated by the stirring action of the fins 88. As a result of such agitation, with the exception of magnetic substance 94 such as iron cans and so forth contained in the input material, the remaining nonmagnetic conductive material and nonconductive material are directed toward the drum 12′ by way of the lower open end 86 of the drum 82 without being affected by the magnetic attraction of the belt 83. In the meanwhile, the magnetic substance 94 is moved upward through the drum 82 with its rotation by the magnetic attraction of the belt 83 and finally reaches the top of the drum 82 where the magnetic belt 83 terminates, so that the magnetic substance 94 falls onto the conveyor 84 and is ejected by the same that pierces through the drum 82 and extends into the drum 12′.

The input material from which the magnetic substance 94 is removed already by the magnetic separator 80, that is, the material ejected from the lower open end 82 and introduced into the cylinder 12′, is separated into nonmagnetic conductive material and nonconductive material by the aforementioned separating apparatus as described in connection with FIG. 3, and the former is ejected sequentially from the upper open end 58′ of the cylinder 12′ while the latter is ejected sequentially from the lower open end 64′ thereof.

The separating apparatus 10 or 10′ of the present invention may be used in combination with various types of magnetic-substance removing apparatus as a substitute for the aforementioned magnetic separator.

According to this invention, as described hereinabove, there exists the advantage that a magnetic field is permitted to rotate at a high speed independently of a drum, into which composite input material is fed, in the direction reverse to rotation of the drum, so that a great electromagnetic force can be exerted for separating nonmagnetic conductive material from the composite input material without applying a great centrifugal force to the entire material in the drum. Consequently, it is rendered possible to achieve efficient, rapid separation and collection of the nonmagnetic conductive material out of the composite input material.

What is claimed is:

1. A nonmagnetic conductive material separating apparatus comprising: a drum composed of nonmagnetic substance and rotated in one direction around a longitudinal center axis thereof, wherein composite input material posterior to previous removal of magnetic substance therefrom is introduced into said drum; and means for generating a magnetic field which rotates in the direction reverse to rotation of said drum substantially coaxially therewith so as to exert an electromagnetic force in the direction reverse to rotation of said drum.

2. The separating apparatus as set forth in claim 1, wherein the longitudinal center axis of said drum is inclined, and an upper open end thereof serves as an inlet for said input material.

3. The separating apparatus as set forth in claim 1, wherein said rotating-field generating means is equipped with an external ring supported rotatably around the outer surface of said drum coaxially therewith while being spaced apart therefrom, a multiplicity of magnets secured to the inner wall of said external ring, and a drive mechanism for rotating said external ring in the direction reverse to rotation of said drum.

4. The separating apparatus as set forth in claim 3, wherein said magnets secured to the inner wall of said external ring are so arrayed as to have different polarities alternately in the circumferential direction of said external ring, and the pole boundary line of each magnet is substantially parallel with the axis of rotation of said external ring.

5. The separating apparatus as set forth in claim 3, wherein said magnets secured to the inner wall of said external ring are so arrayed as to have different polarities alternately in the circumferential direction of said external ring, and the pole boundary line of each magnet is substantially inclined to the axis of rotation of said external ring.

* * * * *